US006864871B1

(12) United States Patent
Okada et al.

(10) Patent No.: US 6,864,871 B1
(45) Date of Patent: Mar. 8, 2005

(54) ACTIVE-MATRIX LIQUID CRYSTAL DISPLAY APPARATUS AND METHOD FOR DRIVING THE SAME AND FOR MANUFACTURING THE SAME

(75) Inventors: Yoshihiro Okada, Yamatotakada (JP); Atsushi Ban, Nara (JP); Masaya Okamoto, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 64 days.

(21) Appl. No.: 09/693,044

(22) Filed: Oct. 20, 2000

(30) Foreign Application Priority Data

Oct. 20, 1999 (JP) ..... P11-298848
Jul. 24, 2000 (JP) ..... P2000-221919

(51) Int. Cl.[7] ..... G09G 3/36
(52) U.S. Cl. ..... 345/90; 349/54
(58) Field of Search ..... 345/87, 90, 92–96, 345/98–100, 103; 349/19, 33, 41, 42, 54

(56) References Cited

U.S. PATENT DOCUMENTS

| | | | | | |
|---|---|---|---|---|---|
| 4,621,260 | A | * | 11/1986 | Suzuki et al. | 345/92 |
| 4,845,482 | A | * | 7/1989 | Howard et al. | 345/58 |
| 4,955,697 | A | * | 9/1990 | Tsukada et al. | 349/38 |
| 5,398,043 | A | * | 3/1995 | Takeda et al. | 345/94 |
| 5,793,346 | A | * | 8/1998 | Moon | 345/92 |
| 5,844,535 | A | * | 12/1998 | Itoh et al. | 345/92 |
| 5,945,970 | A | * | 8/1999 | Moon et al. | 345/92 |
| 6,005,542 | A | * | 12/1999 | Yoon | 345/92 |
| 6,115,017 | A | * | 9/2000 | Mikami et al. | 345/92 |
| 6,300,926 | B1 | * | 10/2001 | Yoneya et al. | 345/87 |
| 6,307,532 | B1 | * | 10/2001 | Aoki | 345/94 |
| 6,344,885 | B1 | * | 2/2002 | Mori et al. | 349/44 |

FOREIGN PATENT DOCUMENTS

| | | | |
|---|---|---|---|
| CN | 1190471 | | 8/1998 |
| CN | 1204833 | A | 1/1999 |
| EP | 0 907 159 | A2 | 4/1999 |
| JP | 5-119742 | | 5/1993 |
| JP | 6-46351 | | 6/1994 |
| JP | 7-20829 | | 1/1995 |
| JP | A-9-54299 | | 2/1997 |
| JP | 11-160733 | | 6/1999 |

OTHER PUBLICATIONS

A copy of the Office Action (dated Dec. 9, 2002) that was issued in connection with corresponding Korean Patent Application No. 2000–61924.

* cited by examiner

*Primary Examiner*—Bipin Shalwala
*Assistant Examiner*—Jeff Piziali
(74) *Attorney, Agent, or Firm*—David C. Conlin; David A. Tucker; Edwards & Angell, LLP

(57) ABSTRACT

An object of the invention is to increase the rate of conforming articles by reducing defects due to leakage of supplementary capacitances in an active-matrix liquid crystal display apparatus of a Cs on Com structure having supplementary capacitances. In a normally-white mode active-matrix liquid crystal display apparatus, a plurality of gate signal lines and source signal lines are formed so as to intersect at right angles, pixel capacitors are connected to the intersections through TFTs, and image display is performed. To the pixel capacitors, supplementary capacitances are connected in parallel. Supplementary capacitance lines are driven by a supplementary capacitance drive circuit so that a potential difference not less than a threshold value of the liquid crystal is maintained from common signal lines on a counter electrode substrate. When a leakage occurs at a supplementary capacitance, the potential difference not less than the threshold value of the liquid crystal is maintained at both ends of the pixel capacitor, so that the pixel is prevented from becoming a bright point and the active-matrix liquid crystal display apparatus is prevented from being defective. Consequently, the rate of conforming articles can be increased.

12 Claims, 10 Drawing Sheets

TIME

ACTIVE-MATRIX LIQUID CRYSTAL DISPLAY APPARATUS AND METHOD FOR DRIVING THE SAME AND FOR MANUFACTURING THE SAME

BACKGROUND OF THE INVENTION

1. Field of the Invention

The present invention relates to an active-matrix liquid crystal display apparatus widely used for liquid crystal televisions, notebook personal computers and the like, a method for driving the same, and a method for manufacturing the same.

2. Description of the Related Art

An active-matrix liquid crystal display apparatus 1 as shown in FIG. 7 has been widely used for liquid crystal televisions, notebook personal computers, various kinds of information processors and the like. In the active-matrix liquid crystal display apparatus 1, liquid crystal 4 is sandwiched between an active-matrix substrate 2 and a counter electrode substrate 3. On the active-matrix substrate 2 and the counter electrode substrate 3, a pixel electrode 7 and a counter electrode 8 are formed on the surfaces of electrical insulating glass substrates 5 and 6, respectively. The light transmittance of the liquid crystal 4 sandwiched between the pixel electrode 7 and the counter electrode 8 changes according to the voltage applied between the electrodes, and an image can be displayed by controlling the applied voltage in accordance with the image. The counter electrode 8 opposed to the pixel electrode 7 is made of a transparent conductive material such as ITO. In a part of the surface of the counter electrode substrate 3, a black matrix (BM) 9 is formed. In the part of the surface of the active-matrix substrate 2 opposed to the part where the black matrix 9 is formed, a thin-film transistor (hereinafter, abbreviated as "TFT") 10 is formed.

FIG. 8 shows an equivalent electrical structure of the active-matrix liquid crystal display apparatus 1 as shown in FIG. 7. The TFT 10 is formed at each of the intersections of gate signal lines 11 and source signal lines 12 on the active-matrix substrate 2. The gate signal lines 11 and the source signal lines 12 intersect at right angles, and supplementary capacitance lines 13 are also formed in parallel to the gate signal lines 11. That is, a plurality of gate signal lines 11 and a plurality of source signal lines 12 are formed so that the TFTs 10 and pixel capacitors (CLC) 14 formed between the pixel electrodes and the counter electrode are connected to the intersections of the gate signal lines Gn, Gn+1, Gn+2, . . . and the source signal lines Sn, Sn+1, Sn+2, Sn+3, . . . The gate signal lines 11 and the source signal lines 12 are electrically insulated from each other. To the gate signal lines 11, the gate electrodes of the TFTs 10 are connected, and to the source signal lines 12, the source electrodes of the TFTs 10 are connected. The drain electrodes of the TFTs 10 are connected to the pixel capacitors 14 and supplementary capacitances (Cs) 15. The counter electrode between which and the pixel electrodes the pixel capacitors 14 are formed is connected in common to common signal lines 16 on the counter electrode substrate 3 of FIG. 7. The other electrodes of the supplementary capacitances 15 are connected in common to the supplementary capacitance lines 13 on the active-matrix substrate 2 of FIG. 7. The supplementary capacitance lines 13 are connected to the common signal lines 16 outside the display area or at a peripheral circuit. The pixel electrodes form the pixel capacitors 14 through the layer of the liquid crystal 4, and form the supplementary capacitances 15 through a gate insulating film that electrically insulates the gate signal lines 11 and the supplementary capacitance lines 13 from the source signal lines 12. This structure is called a Cs on Com structure.

In the active-matrix liquid crystal display apparatus as shown in FIG. 8, a scanning signal is provided so that Gn, Gn+1, Gn+2, . . . of the gate signal lines 11 are selected one by one and only the TFT 10 connected to the selected gate signal line 11 is on. Methods of forming the supplementary capacitances Cs include a method called a Cs on Gate structure in which the supplementary capacitances Cs are formed between the gate electrodes of the TFTs 10 connected to the preceding gate signal lines 11 scanned immediately before, and the pixel electrodes. In the Cs on Gate structure, since the supplementary capacitance lines 13 are unnecessary, a large light transmission area can be secured. However, since the supplementary capacitances Cs are connected to the gate signal lines 11, the signal delay at the gates of the TFTs 10 is long. Therefore, the Cs on Com structure is frequently adopted for large-size active-matrix liquid crystal display apparatuses and for, even in the case of small-size apparatuses, high-resolution liquid crystal display apparatuses in which the density of the gate signal lines 11 is high.

In a method for driving the active-matrix liquid crystal display apparatus 1 as shown in FIG. 8, when writing to the pixels of the n-th line is performed, an on signal is input to the gate signal line 11 that is the gate line Gn of the n-th line. The on signal is provided at Vgh as the gate potential at which the TFTs 10 are brought into conduction. To the gate lines other than Gn, an off signal of Vgl which is the potential that drives the TFTs 10 into cutoff is input. Consequently, only the TFT 10 of the n-th line is conducting. At this time, a signal voltage at which the pixels of the n-th line are to be charged is supplied to the source signal lines 12. When the writing to the pixels of the n-th line is finished, the off signal is input to the gate line Gn, and the on signal is input to the next gate line Gn+1. By repeating this scanning, the pixel capacitors 14 corresponding to all the pixels can be charged at a given voltage value. Since the optical transmittance of the liquid crystal 4 of FIG. 7 changes according to the voltage applied to the pixel capacitors 14 formed by the liquid crystal 4 between the pixel electrodes and the counter electrode, a given image can be displayed by adjusting the amount of transmitted light from the backlight provided on the back surface of the active-matrix substrate 2.

In active-matrix driving, at each pixel, after a signal voltage is provided in one scanning, it is necessary to hold the potential during the one frame period to the next scanning. However, the provided potential cannot be held only by the pixel capacitors 14, and the pixel potential is changed by the leakage current of the liquid crystal 4, the off current of the TFTs 10, leakage of alternating components through a part of capacitor coupling between signal lines and the like. The change of the pixel potential at the pixel capacitors 14 results in degradation in display quality. To suppress the display degradation, the supplementary capacitances 15 are disposed in parallel to the pixel capacitors 14. Change of the potential difference between both ends of the pixel capacitors 14 can be reduced by providing the supplementary capacitances 15.

FIGS. 9A to 9C show the general outlines of signal waveforms that drive the gate signal lines 11 and the common signal lines 16 of the active-matrix liquid crystal display apparatus 1 shown in FIG. 7. Since the supplementary capacitance lines 13 are connected to the common signal lines 16, a Com signal is equivalent to a Cs signal. FIG. 9A shows a gate signal applied to the gate signal line 11. FIG. 9B shows a common signal applied to the common signal lines 16. FIG. 9C shows the gate signal and the common signal so as to be superposed on each other. When application of a direct-current bias to the liquid crystal 4 is continued, the display characteristic deteriorates. Therefore, for data signals supplied through the source signal lines 12, a driving method that reverses the signals every frame or every scanning line period is employed. FIGS. 9A to 9C show an example of a 1H reversal driving in which the signals are reversed every one scanning line period. The gate signal that disables the TFTs 10 is changed between two levels Vgl+ and Vgl−every scanning line period.

Japanese Examined Patent Publication JP-B2 6-46351 (1994) discloses, as a method for driving an active-matrix liquid crystal display apparatus, a structure in which the gate signal is switched between at least two levels every field in a period during which the transistor serving as the active-matrix switching element is nonconducting. This makes the influence of occurrence of defective display inconspicuous when the transistor is defective and the gate signal is directly applied to the pixel electrode.

Display methods of liquid crystal display apparatuses include a normally-white mode in which white display is provided when no voltage is applied across the liquid crystal and a normally-black mode in which black display is provided when no voltage is applied. Generally, the normally-white mode is frequently used in which a high contrast ratio can be secured and the control margin of thickness of the liquid crystal cell is large.

FIGS. 10A and 10B show the normally-white mode and the normally-black mode so as to be compared based on the correspondence between the voltage applied between the electrodes and the transmittance. In the normally-white mode, the transmittance decreases as the applied voltage increases. In the normally-black mode, the transmittance increases as the applied voltage increases. In each mode, the voltage at which the transmittance is 90% is a threshold voltage Vth.

The manufacturing cost of the active-matrix liquid crystal display apparatus 1 largely depends on the manufacturing yield. Therefore, preventing articles having a few defects from being regarded as defective articles as well as reducing defects caused in manufacture is important. Defects of liquid crystal display apparatuses include line defects that show up with respect to pixels arranged on a line and point defects that show up in units of pixels. The point defects are divided into bright points that are always displayed in white and black points that are always displayed in black. For example, for AV apparatuses such as liquid crystal televisions, since line defects and bright points are extremely conspicuous, even an article having only one line defect or bright point is regarded as defective. On the contrary, since black points are not very conspicuous, several black points are allowed.

The prior art of JP-B2 6-46351 is intended for making white point defects, that is, bright points based on active-matrix defects inconspicuous and preventing direct current from being applied to the liquid crystal to destroy the liquid crystal.

On the active-matrix substrate of the Cs on Com structure in which supplementary capacitances are provided for suppressing the change of the pixel potential between frames, leakage is apt to occur between pixel electrodes and the auxiliary electrode lines because of the structure. In a liquid crystal display apparatus that provides display according to the normally-white mode, when leakage occurs at a supplementary capacitance, the defect with respect to the pixel becomes a bright point, so that the manufacturing yield significantly decreases. JP-B2 6-46351 shows nothing as to measures against bright points associated with leakage of the supplementary capacitances. According to the method of JP-B2 6-46351, since a voltage such that "the potential of the counter electrode 8>the voltage in the off period of the gate line" is always applied to the liquid crystal, no effect of improving the reliability of the liquid crystal is obtained. (To improve the reliability, it is necessary to switch the polarity of the voltage applied to the liquid crystal layer.) Therefore, it is useless for the voltage of the gate signal in the second period to have not less than two levels. A method has also been proposed in which, to make bright points inconspicuous, correction is performed by use of a laser or the like to convert the bright points into black points or points that always display halftones. However, to perform the correction with reliability, it is necessary to previously dispose a correctable pattern, and disposition of such a pattern decreases the opening ratio at all the pixels, so that the image brightness decreases. In addition, since the step of the correction using a laser or the like is necessary and an apparatus for the correction such as a laser is necessary, the manufacturing cost increases.

SUMMARY

An object of the invention is to provide an active-matrix liquid crystal display apparatus, a method for driving the same and a method for manufacturing the same in which the rate of conforming articles can be increased by making the defects based on leakage of supplementary capacitances inconspicuous.

The invention provides an active-matrix liquid crystal display apparatus comprising:

an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements;

a counter electrode substrate including a counter electrode formed thereon, the counter electrode being opposed to the pixel electrodes;

a liquid crystal sandwiched between the active-matrix substrate and the counter electrode substrate;

the active-matrix substrate further including supplementary capacitance lines which are formed in parallel to the scanning electrode lines, and supplementary capacitances for holding display data which are connected between the pixel electrodes and the supplementary capacitance lines, the apparatus further comprising:

a supplementary capacitance drive circuit for driving the supplementary capacitance lines so that a predetermined potential difference from a voltage applied to the counter electrode is always maintained when any of the pixel electrodes and supplementary capacitance lines leaks.

According to the invention, the liquid crystal is sandwiched between the active-matrix substrate and the counter electrode substrate to form a liquid crystal display apparatus. On the active-matrix substrate, the pixel electrodes are connected to the intersections of the scanning electrode lines and the data electrode lines through the switching elements. The supplementary capacitance lines are formed in parallel to the scanning electrode lines, and the supplementary capacitances for holding display data are connected between the pixel electrodes and the supplementary capacitance lines. The supplementary capacitance drive circuit for driving the supplementary capacitance lines drives the supplementary capacitance lines so that the predetermined potential difference from the voltage applied to the counter electrode is always maintained. When any of the supplementary capacitance lines is defective and a large leakage occurs, a voltage substantially the same as the voltage applied to the auxiliary electrode lines is applied to the pixel electrode. Since this voltage maintains the predetermined potential difference from the voltage applied to the counter electrode, when a few defects are caused, by maintaining the potential difference that makes the defects inconspicuous in accordance with the display mode as the liquid crystal display apparatus, the rate of nonconforming articles can be reduced to increase the rate of conforming articles.

As described above, according to the invention, the supplementary capacitance drive circuit for suppressing a change of the pixel potential difference is driven so that the predetermined potential difference is maintained with respect to the voltage applied to the counter electrode. Accordingly, even when a supplementary capacitance leakage occurs, the corresponding pixel can be made inconspicuous as a defect. Consequently, the rate of conforming articles can be increased.

In the invention it is preferable that a display mode of the liquid crystal display apparatus is normally-white and the supplementary capacitance drive circuit drives the supplementary capacitance so that a potential difference not less than a threshold voltage of the liquid crystal is maintained with respect to the counter electrode.

According to the invention, the display mode of the liquid crystal display apparatus is normally-white and the supplementary capacitance is driven so that the potential difference not less than the threshold value of the liquid crystal is maintained with respect to the counter electrode, so that a pixel having a defect can be prevented from being conspicuous as a bright point and the rate of conforming articles can be increased.

As described above, according to the invention, in the normally-white mode liquid crystal display apparatus, the rate of conforming articles can be increased by making defects that become bright points inconspicuous.

In the invention it is preferable that a display mode of the liquid crystal display apparatus is normally-black mode, and the supplementary capacitance drive circuit drives the supplementary capacitance lines so that a potential difference less than a threshold voltage of the liquid crystal is maintained from the counter electrode.

According to the invention, the display mode of the liquid crystal display apparatus is normally-black mode and the supplementary capacitance lines are driven so that the potential difference less than the threshold value of the liquid crystal is maintained from the counter electrode, so that a pixel having a defect can be prevented from being conspicuous as a bright point and the rate of conforming articles can be increased.

As described above, according to the invention, in the normally-black mode liquid crystal display apparatus, pixels that always become bright points can be made inconspicuous by displaying the pixels as halftone points or black points.

In the invention, it is preferable that the supplementary capacitance lines are separated every scanning electrode line to which the switching element for switching-driving a pixel potential difference connected through the supplementary capacitance is connected at the intersection, and the supplementary capacitance drive circuit drives the supplementary capacitance lines with a polarity being reversed every time an on signal is input to the scanning electrode line driven at a stage preceding the scanning electrode line.

According to the invention, since the supplementary capacitance lines are separated every scanning electrode line and the polarity of the signal that drives the supplementary capacitance lines is reversed every time the on signal is input to the scanning electrode driven at the stage preceding the scanning electrode line, direct current can be prevented from being applied to the pixel electrode to which the voltage applied to the supplementary capacitance lines is supplied through the supplementary capacitance that becomes unnecessary because of leakage or the like, whereby the liquid crystal can be prevented from deteriorating.

As described above, according to the invention, since the polarity of the voltage applied to drive the supplementary capacitances is reversed every frame, driving by direct current is avoided to prolong the life of the liquid crystal layer, so that the reliability can be increased.

In the invention, it is preferable that the switching element and the pixel electrode are disconnected from each other at a pixel where the leakage between the pixel electrode and the supplementary capacitance line occurs.

According to the invention, since the switching element and the pixel electrode are disconnected from each other at the pixel where the leakage between the pixel electrode and the supplementary capacitance line occurs, the rate of conforming articles can be increased by making the defect more inconspicuous.

The invention provides a method for driving an active-matrix liquid crystal display apparatus comprising an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements; a counter electrode substrate including a counter electrode formed thereon, the counter electrode being opposed to the pixel electrodes; and a liquid crystal sandwiched between the active-matrix substrate and the counter electrode substrate, the active-matrix substrate further including supplementary capacitance lines which are formed in parallel to the scanning electrode lines, and supplementary capacitances for holding display data which are connected between the pixel electrodes and the supplementary capacitance lines, the method comprising:

employing a constitution in which display is carried out in normally-white mode, for the active-matrix liquid crystal display apparatus; and driving the supplementary capacitances so that a potential difference not less than a threshold voltage of the liquid crystal is always maintained with respect to the counter electrode when any of the pixel electrodes and supplementary capacitance lines leaks.

According to the invention, the supplementary capacitance is driven so that the potential difference not less than the threshold voltage of the liquid crystal is maintained with respect to the counter electrode. Accordingly, even when any of the supplementary capacitance lines is defective and a large leakage occurs, the defect can be prevented from being always displayed as a bright point due to a reduction in potential difference between the pixel electrode and the counter electrode caused by the leakage, and is forcibly made a black point, so that the rate of conforming articles can be increased.

As described above, according to the invention, in the normally-white mode liquid crystal display, the rate of conforming articles can be increased by making the defects that cause bright points inconspicuous.

In the invention, it is preferable that the method further comprises separating the supplementary capacitance lines every scanning electrode line to which the switching element for switching-driving the pixel electrode connected through the supplementary capacitance is connected at the intersection; and driving the supplementary capacitance lines with a polarity being reversed every time anon signal is input to the scanning electrode line which is driven at a stage preceding the scanning electrode line.

According to the invention, since the polarity of the voltage applied to make the point defect inconspicuous is changed every frame, direct current driving is avoided. Accordingly the reliability of the liquid crystal can be increased.

As described above, according to the invention, by changing every frame the polarity of the signal that drives the pixel electrodes through the supplementary capacitances, the liquid crystal can be prevented from deteriorating due to direct current driving.

In the invention, it is preferable that the switching element and the pixel electrode are disconnected from each other at a pixel where the leakage between the pixel electrode and the supplementary capacitance line occurs.

According to the invention, since the switching element and the pixel electrode are disconnected from each other at the pixel where the leakage occurs, the rate of conforming articles can be increased by making the defect more inconspicuous.

The invention provides a method for driving an active-matrix liquid crystal display apparatus comprising an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements; a counter electrode substrate including a counter electrode formed thereon, the counter electrode being opposed to the pixel electrodes; and a liquid crystal sandwiched between the active-matrix substrate and the counter electrode substrate; the active-matrix substrate further including supplementary capacitance lines which are formed in parallel to the scanning electrode lines, and supplementary capacitances for holding display data which are connected between the pixel electrodes and the supplementary capacitance lines, the method comprising:

employing a constitution in which display is carried out in normally-black mode, for the active-matrix liquid crystal display apparatus; and driving the supplementary capacitances so that a potential difference less than a threshold voltage of the liquid crystal is always maintained with respect to the counter electrode when any of the pixel electrodes and supplementary capacitance lines leaks.

According to the invention, the display mode of the active-matrix liquid crystal display apparatus is normally-black and the supplementary capacitances are driven so that the potential difference less than the threshold value of the liquid crystal is maintained by a predetermined potential difference from the voltage applied to the counter electrode. Accordingly the potential difference between the pixel electrode and the counter electrode of the pixel having a defect such as a leakage at the supplementary capacitance is maintained to be the potential difference applied to the supplementary capacitance signal lines and is less than the threshold value of the liquid crystal, so that the transmittance is always low and the defect never become a bright point to be conspicuous. Consequently, the rate of conforming articles can be increased.

As described above, according to the invention, in the normally-black mode liquid crystal display apparatus, the rate of conforming articles can be increased by making the defects that always become bright points inconspicuous.

The invention provides a method for manufacturing an active-matrix liquid crystal display apparatus, comprising:

preparing an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements and a counter electrode substrate including a counter electrode formed thereon, the counter electrode being opposed to the pixel electrodes, the active-matrix substrate further including supplementary capacitance lines which are formed in parallel to the scanning electrode lines, and supplementary capacitances for holding display data which are connected between the pixel electrodes and the supplementary capacitance lines;

sandwiching a liquid crystal between the active-matrix substrate and the counter electrode substrate;

forming a supplementary capacitance drive circuit and connecting the supplementary capacitance drive circuit to the supplementary capacitance lines to drive the supplementary capacitance lines so that a predetermined potential difference from a voltage applied to the counter electrode is always maintained when any of the pixel electrodes and supplementary capacitance lines leaks;

inspecting whether there is a defect on a side of the active-matrix substrate;

determining, in the case where there is a defect, which pixel electrode is affected by the defect; and causing a supplementary capacitance connected to the pixel electrode determined to be affected by the defect to leak.

According to the invention, by inspecting whether there is a defect on the side of the active-matrix substrate or not and in the case where there is a defect, causing the supplementary capacitance connected to the pixel electrode affected by the defect to leak, the voltage that drives the supplementary capacitance lines is maintained to have the predetermined potential difference from the voltage that drives the counter electrode. Accordingly the rate of conforming articles can be increased by making the defect on the active-matrix substrate side inconspicuous without directly correcting the defect.

As described above, according to the invention, a defect of a pixel due to a defect on the side of the active-matrix substrate is also relieved by the correction to increase the leakage of the supplementary capacitance, so that the rate of conforming articles as the active-matrix liquid crystal display apparatus can be increased.

In the invention, it is preferable that the method further comprises disconnecting the pixel electrode determined to be affected by the defect from the switching element connected to the pixel electrode.

According to the invention, since the pixel electrode affected by the defect and the switching element connected to the pixel electrode are disconnected from each other, the rate of conforming articles can be increased by making the defect inconspicuous.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
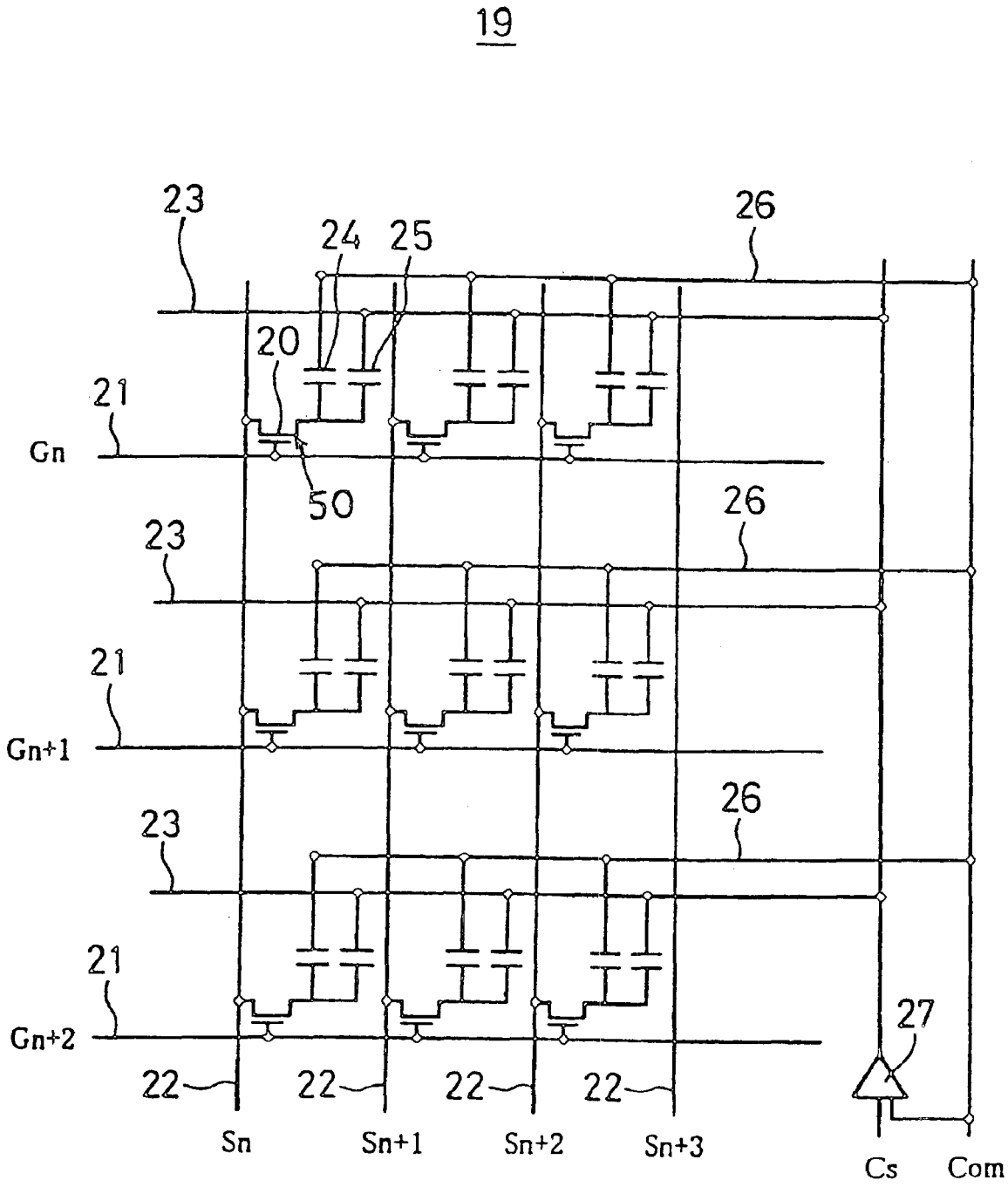
FIG. 1 is an equivalent circuit diagram showing the electric structure of an active-matrix liquid crystal display apparatus 19 as an embodiment of the invention.

Now referring to the drawings, preferred embodiments of the invention are described below.

FIG. 1 diagrammatically shows the electric structure of an active-matrix liquid crystal display apparatus 19 as an embodiment of the invention. A TFT 20 serving as a switching element is provided at each of the intersections of a plurality of gate signal lines 21 serving as scanning signal lines and a plurality of source signal lines 22 serving as data signal lines. The gate signal lines 21 and the source signal lines 22 are electrically insulated from each other by a gate insulating film. The gate signal lines 21 are connected to the gate electrodes of the TFTs 20. The source signal lines 22 are connected to the source electrodes of the TFTs 20. Supplementary capacitance lines 23 are also provided in parallel to the gate signal lines 21. The supplementary capacitance lines 23 are electrically insulated from the source signal lines 22 by the gate insulating film. The drain electrodes of the TFTs 20 are connected to pixel capacitors 24 formed between pixel electrodes and a counter electrode and to supplementary capacitances 25 formed between the pixel capacitors 24 and the supplementary capacitance lines 23. The TFTs 20, the gate signal lines 21, the source signal lines 22 and the supplementary capacitance lines 23 are formed on an active-matrix substrate, and a counter electrode substrate where the counter electrode is formed is disposed so as to be opposed to the active-matrix substrate. On the counter electrode substrate, common signal lines 26 to which the counter electrode is connected in common are provided. In the active-matrix liquid crystal display apparatus 19 of this embodiment, the supplementary capacitance lines 23 are driven by a supplementary capacitance drive circuit 27 independently of the common signal lines 26.

Figure 2A:
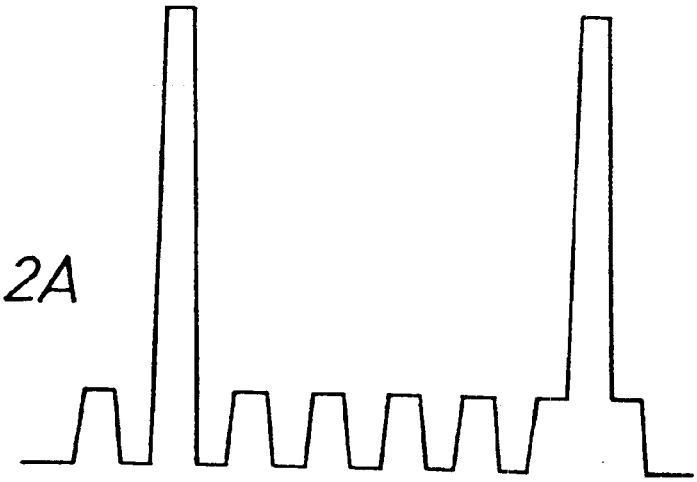
FIGS. 2A to 2D are signal waveform charts showing a method for driving the active-matrix liquid crystal display apparatus 19 of FIG. 1.
Figure 2B:
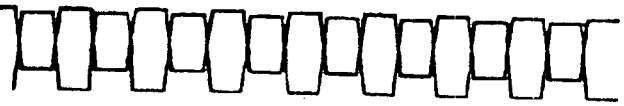
Figure 2C:
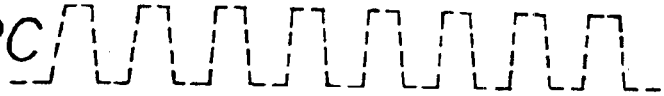
Figure 2D:
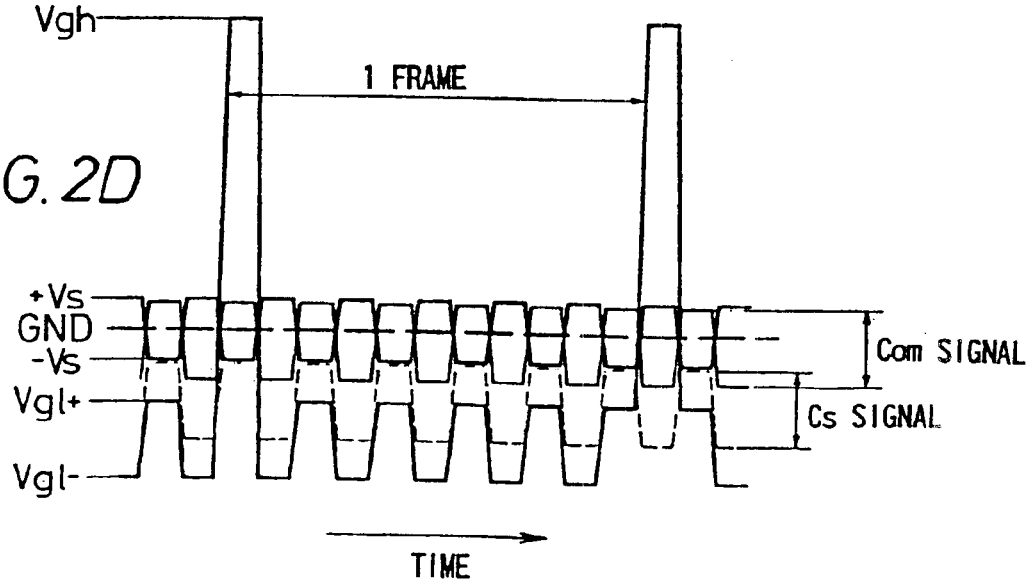

FIGS. 2A to 2D show a driving method for the active-matrix liquid crystal display apparatus 19 of the embodiment of FIG. 1. FIG. 2A shows the waveform/of a gate signal supplied to the gate signal lines 21. FIG. 2B shows the waveform of a common signal supplied to the common signal lines 26. FIG. 2C shows the signal waveform of the supplementary capacitance lines 23 driven by the supplementary capacitance drive circuit 27. FIG. 2D shows the gate signal, the common signal and the signal waveforms that drive the supplementary capacitance lines 13, so as to be superposed on one another.

Figure 10A:
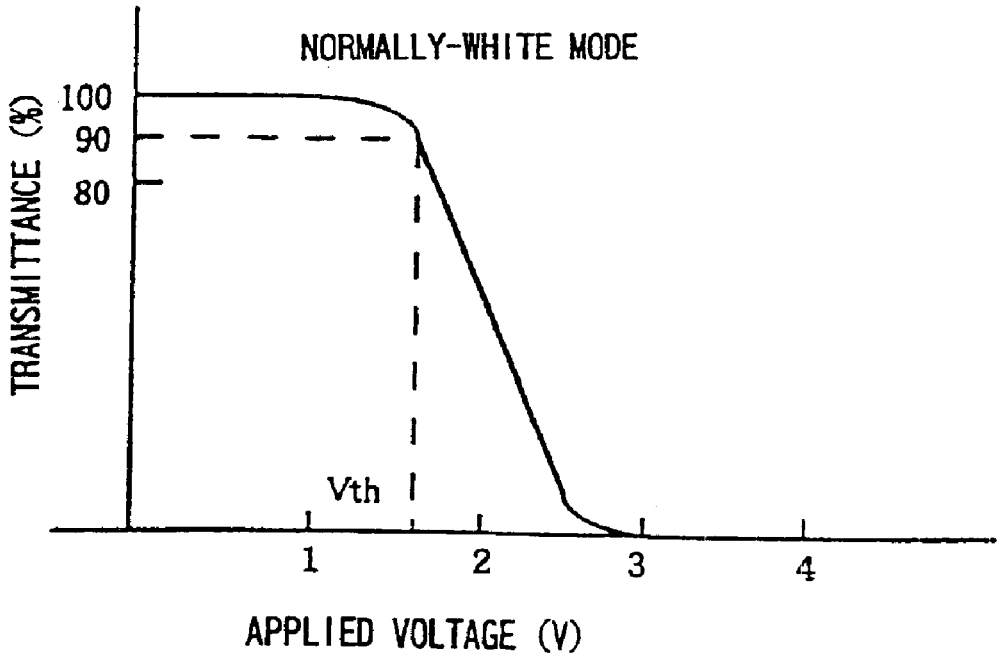
FIG. 10A PRIOR ART
FIGS. 10A and 10B are graphs showing the normally-white mode and normally-black mode commonly used for liquid crystal display apparatuses, so as to be compared based on the relationship between the applied voltage and the transmittance.
Figure 10B:
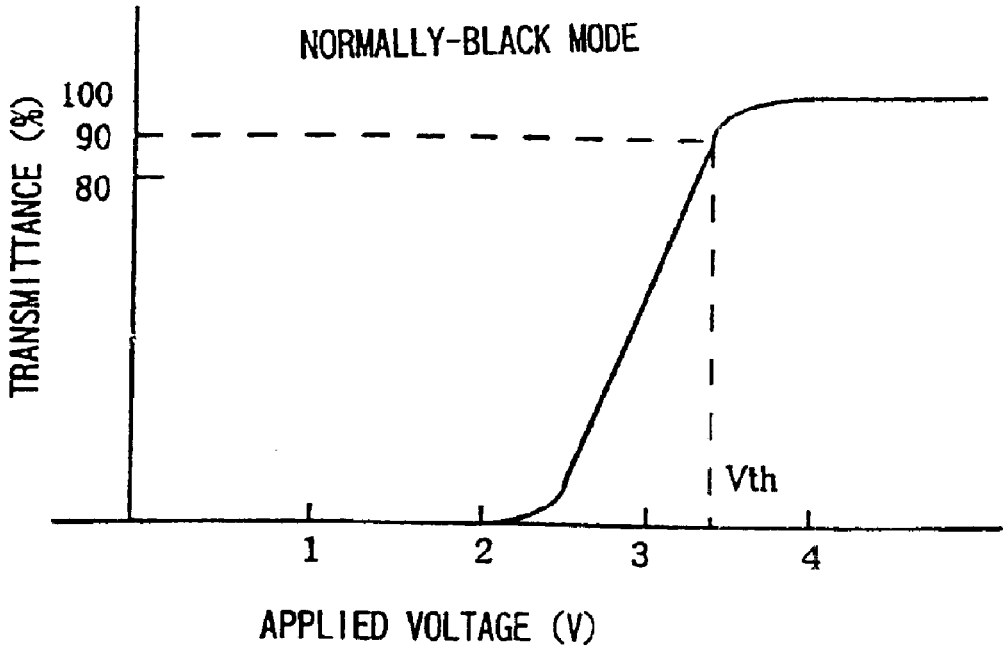
FIG. 10B PRIOR ART

Referring to FIG. 1 and FIGS. 2A to 2D, when writing to the pixels of the n-th line is performed, the on signal is input only to the gate signal line 21 that is the gate line Gn of the n-th line at the potential Vgl that brings the TFTs 20 into conduction. At this time, to the gate lines other than Gn, the off signal of Vgl that is the potential driving the TFTs 20 into cutoff is input. Consequently, only the TFT 20 of the n-th line is selectively enabled. At this time, a voltage at which the pixels of the n-th line are to be charged is supplied to the source signal lines 12 as the source signal. To the liquid crystal layer of each pixel, the potential difference between the source signal and the common signal Com is applied, and the supplementary capacitances 25 are charged by the potential difference between the source signal and the voltage applied from the supplementary capacitance drive circuit 27 to the supplementary capacitance lines 23. When the writing of the pixels of the n-th line is finished, the off signal is input to the gate line Gn, and the on signal is input to the gate line Gn+1 for which scanning is performed next. By repeating the scanning that enables the gate lines one by one as described above, all the pixels can be charged by supplying a given signal voltage to the pixels. Since the transmittance of the liquid crystal layer between the pixel electrodes and the counter electrode changes according to the applied voltage as shown in FIG. 10, a given image can be displayed by changing the condition of transmission of the light from the backlight on the back surface of the active-matrix substrate.

Figure 8:
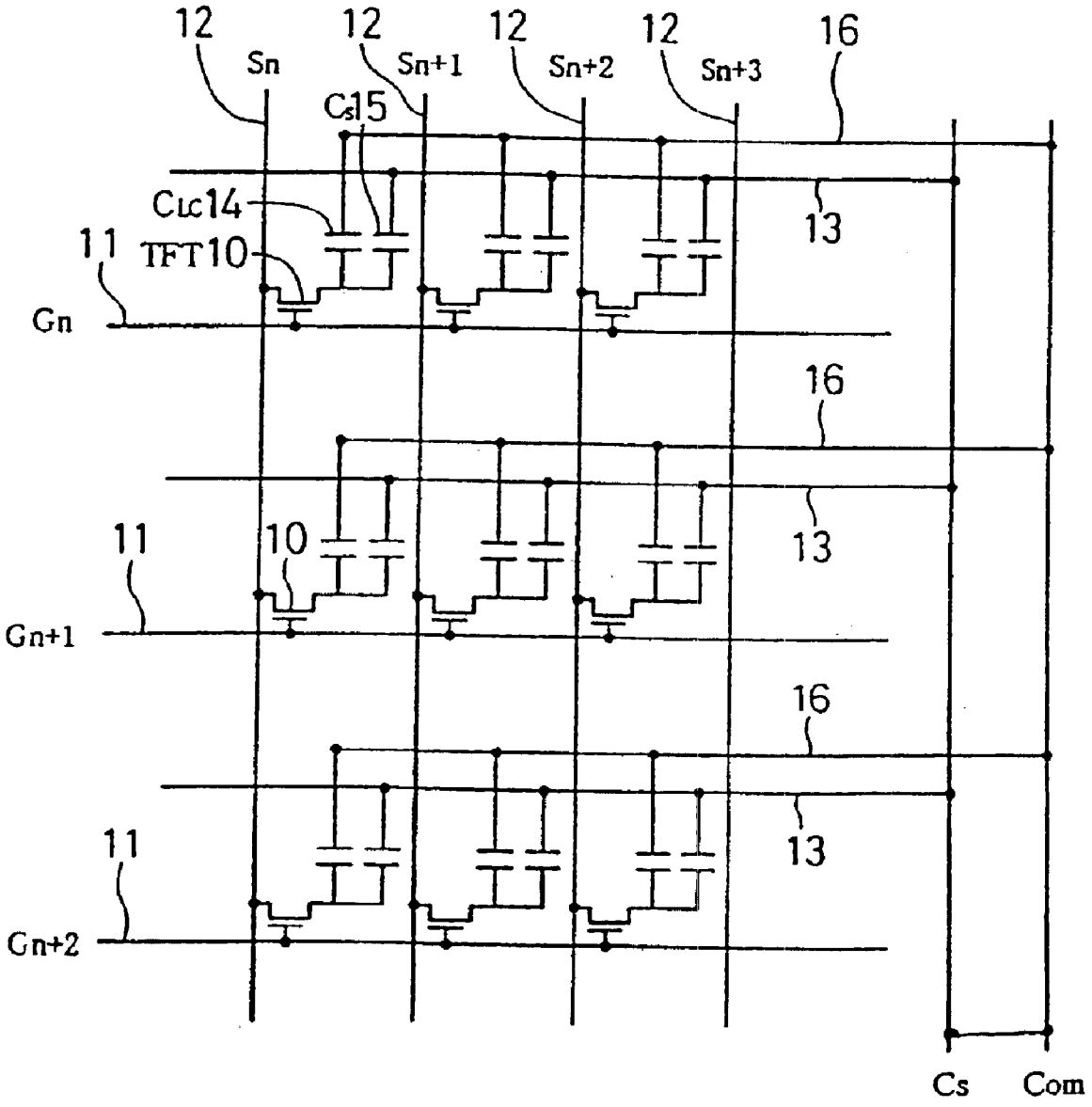
FIG. 8 Prior Art
FIG. 8 is an equivalent circuit diagram showing the electric structure of the active-matrix liquid crystal display apparatus 1 of FIG. 7.
Figure 9A:
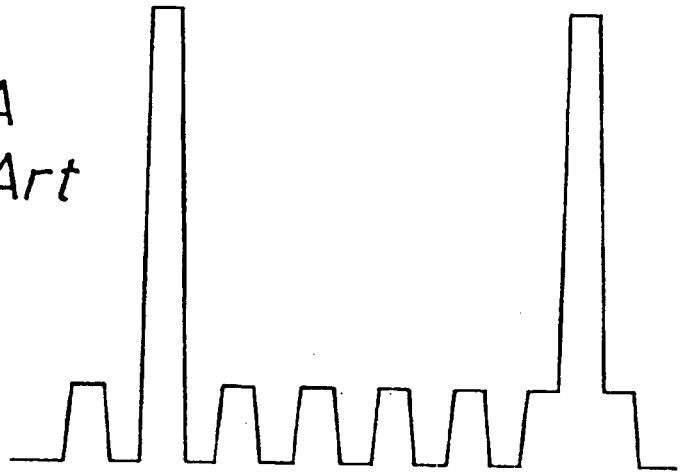
FIG. 9A Prior Art
FIGS. 9A to 9C are signal wave form charts showing the method for driving the active-matrix liquid crystal display apparatus 1 of FIG. 8.
Figure 9B:
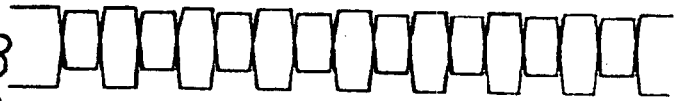
FIG. 9B Prior Art
Figure 9C:
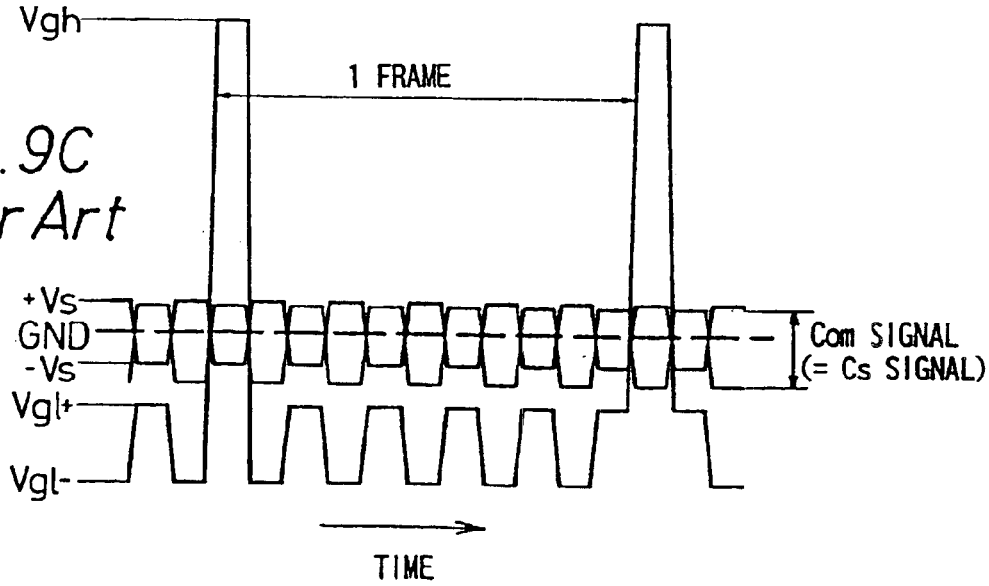
FIG. 9C Prior Art

As shown in FIG. 8, according to the conventional method for driving the active-matrix liquid crystal display apparatus 1, the supplementary capacitance lines 13 and the common signal lines 16 are electrically connected, and to the supplementary capacitance lines 13 is applied the same signal voltage as that of the counter electrode which is applied to the common signal lines 16 is applied. Consequently, when the leakage at the supplementary capacitances 15 is large, the potential difference between both ends of the pixel capacitors 14 is small, so that when display is carried out in the normally white mode, bright points are always displayed. In this embodiment, the supplementary capacitance lines 23 are driven by the supplementary capacitance drive circuit 27 so that a predetermined potential difference is maintained from the common signal lines 26. As the potential difference, in this embodiment, for example, a voltage 2 V lower than the Com signal supplied to the common signal lines 26 is supplied to the supplementary capacitance lines 23. Since the common signal lines 26 change by ±2.5 V every gate period, the Cs signal that drives the supplementary capacitance lines 23 is also changed by ±2.5 V from a reference level, for example, 2 V lower than the reference level of the Com signal that drives the common signal lines 26. Since this reduces bright points caused by defects of the active-matrix substrate of the active-matrix liquid crystal display apparatus using the TFTs 20 as switching elements, the substantial rate of conforming articles can be increased.

For example, when a leakage occurs at the supplementary capacitance 25 connected in parallel to the pixel electrode connected to the drain electrode 50 of one TFT 20 shown in FIG. 1, according to the conventional driving method, the voltage applied to the liquid crystal layer, is 0 V, so that a bright point is generated. In this embodiment, when a leakage defect is caused at the supplementary capacitance 25, the Cs signal that drives the supplementary capacitance lines 23 is applied to the pixel electrode and the Cs signal always has a voltage difference of −2 V from the Com signal supplied to the common signal lines 26 that drives the counter electrode, so that the defective part does not become a bright point but is displayed as a halftone point so as to be inconspicuous. Conventionally, a correction step for correcting such bright points is necessary. The correction step requires complicated work and it is necessary to previously provide an exclusively used correction pattern on the active-matrix substrate and on the counter electrode substrate, so that the opening ratio as a liquid crystal display apparatus decreases.

In this embodiment, since the threshold voltage of the liquid crystal layer is approximately 15 V, the potential difference of −2 V between the common signal Com applied to the common signal lines 26 and the Cs signal applied to the supplementary capacitance lines 23 is always applied, so that bright points can be displayed as halftone points.

Moreover, bright points due to defects on the active-matrix side, for example, defective enablement of the TFTs 20 and defective contact between the TFTs 20 and the pixel electrodes can be displayed, also for pixels that become bright points in a normally-white mode liquid crystal display apparatus, as halftone points so as to be inconspicuous as defects so that no adverse effect is produced on the quality of the displayed image, by causing the part of the supplementary capacitance 25 to electrically leak by use of a laser or the like and cutting the drain electrode 50 with a laser to thereby disconnect the switching element and the pixel electrode so that the voltage that drives the supplementary capacitance lines 23 is applied to the pixel electrode. Conventionally, the correction of the defects that become bright points requires complicated work as a correction step and it is necessary to previously provide an exclusively used correction pattern, so that the opening ratio is sacrificed. In this embodiment, however, since it is necessary only to perform a correction that increases the leakage at the supplementary capacitance 25, it is unnecessary to provide an exclusively used pattern, so that the opening ratio can be prevented from decreasing.

While in this embodiment, the threshold voltage of the liquid crystal layer is approximately 15 V and the potential difference of the voltage that drives the supplementary capacitance lines 23 from the Com that drives the common signal lines 26 is −2 V, similar effects are obtained when the potential difference of the voltage applied to the supplementary capacitance lines 23 from the voltage Com applied to the common signal lines 26 is not more than −15 V or not less than 15 V. When the liquid crystal layer provides display according to the normally-white mode, the invention can be applied irrespective of the threshold value. While in this embodiment, the Com signal supplied to the common signal lines 26 is changed by ±2.5 V every scanning line period, a similar method can be applied when the common signal Com is a direct-current signal.

Figure 3:
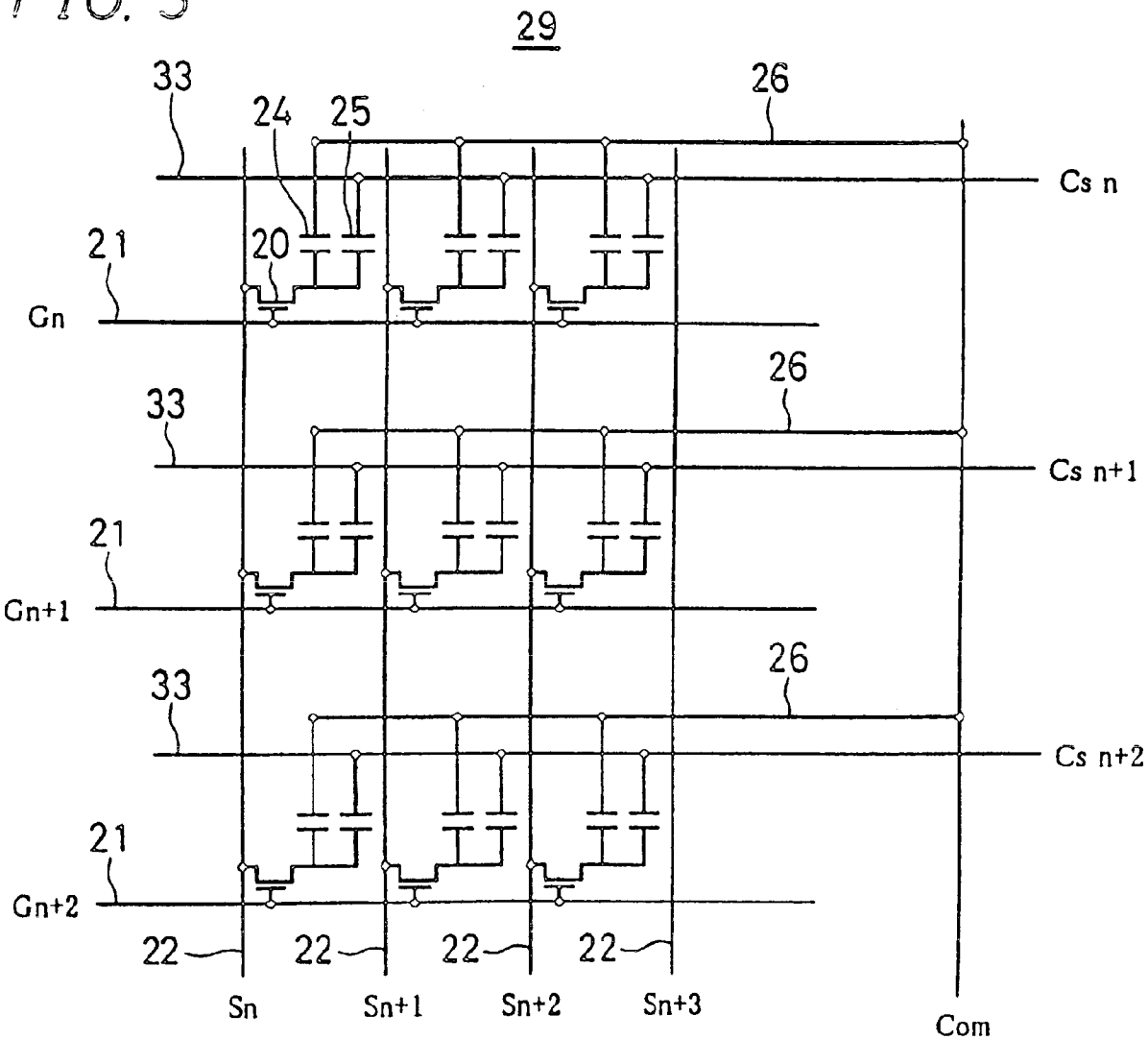
FIG. 3 is an equivalent circuit diagram showing the electric structure of an active-matrix liquid crystal display apparatus 29 as another, embodiment of the invention.
Figure 4A:
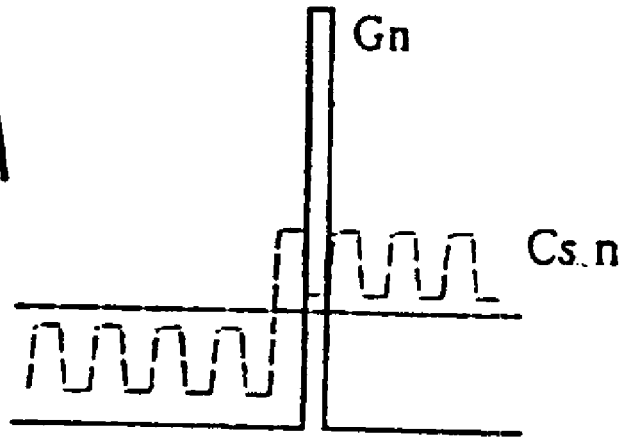
FIGS. 4A to 4C are signal waveform charts showing a condition in which the polarity of a signal that drives supplementary capacitance lines 33 is changed in the active-matrix liquid crystal display apparatus 29 of FIG. 3.
Figure 4B:
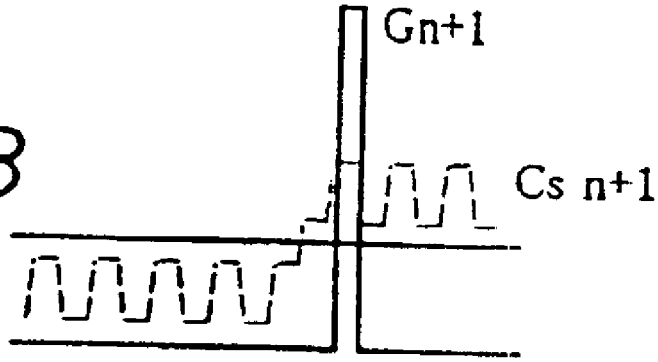
Figure 4C:
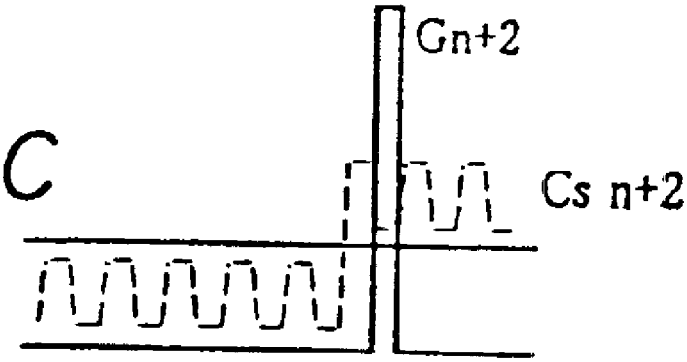
Figure 4C:
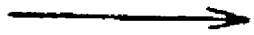
Figure 7:
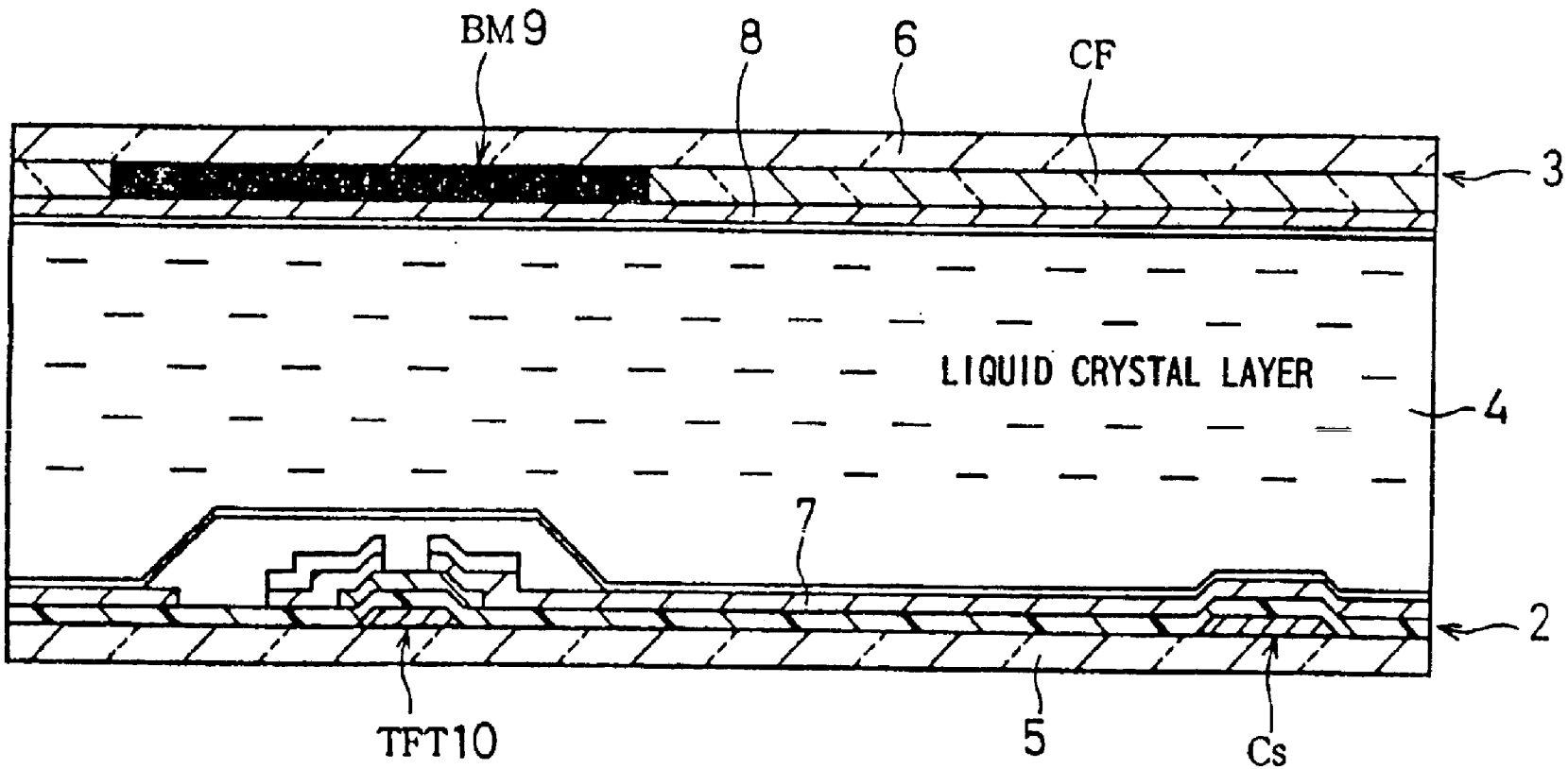
FIG. 7 Prior Art
FIG. 7 is a schematic cross-sectional view showing the structure of the conventional active-matrix liquid crystal display apparatus 1.

FIG. 3 diagrammatically shows the electric structure of an active-matrix liquid crystal display apparatus 29 as another embodiment of the invention. In this embodiment, parts corresponding to those of the embodiment of FIG. 1 are designated by the same reference numerals, and overlapping descriptions are omitted in principle. What is noteworthy about this embodiment is that supplementary capacitance lines 33 are separated every gate signal line 21 that simultaneously selects as one scanning line the pixel capacitor 24 to which the supplementary capacitance 25 is connected and are driven with the polarity being reversed every frame as shown in FIGS. 4A to 4C. In this embodiment, like the conventional method for driving the active-matrix liquid crystal display apparatus 1 shown in FIG. 7, when writing to the pixels of the n-th line is performed, the on signal of the potential Vgh is input to the gate line Gn of the n-th line. At this time, to the gate lines other than Gn, the off signal of Vgl is input. To the supplementary capacitance lines 33 of the first to the n-th lines, a voltage 2 V lower than the Com signal supplied to the common signal lines 26 is applied. To the supplementary capacitance lines 33 of the n+1−th and succeeding lines, a signal 2 V higher than the Com signal supplied to the common signal lines 26 is input. In synchronism with the input of the on signal to the gate of the n-th line, the drive signal supplied to the supplementary capacitance line 33 of the n+1-th line changes from Com+2 V to Com-2 V. That is, when the gate signal line on the preceding stage is enabled, the supplementary capacitance line on the succeeding stage is reversed. When the writing to the pixels of the n-th line is finished, the off signal is input to the gate line Gn and the on signal is input to the gate line Gn+1. At this time, the Cs signal supplied to the supplementary capacitance line 33 of the n+1-th line changes from Com+2 V to Com-2 V. When application of a direct-current voltage to the liquid crystal layer is continued, a V-T characteristic as shown in FIG. 10 representative of a relationship between the transmittance and the applied voltage deteriorates, so that there is a possibility that even pixels that can be made black points in the embodiment of FIG. 10 become bright points. However, for normal uses, the method of the embodiment of FIG. 1 is good enough. However, when the liquid crystal display apparatus is used under particularly hostile environments and when a liquid crystal material with low reliability is used, by changing every frame period the polarity of the voltage applied to the liquid crystal layer of the bright point pixels which have been made black points by the method of this embodiment, the deterioration of the V-T characteristic can be avoided.

Figure 5A:
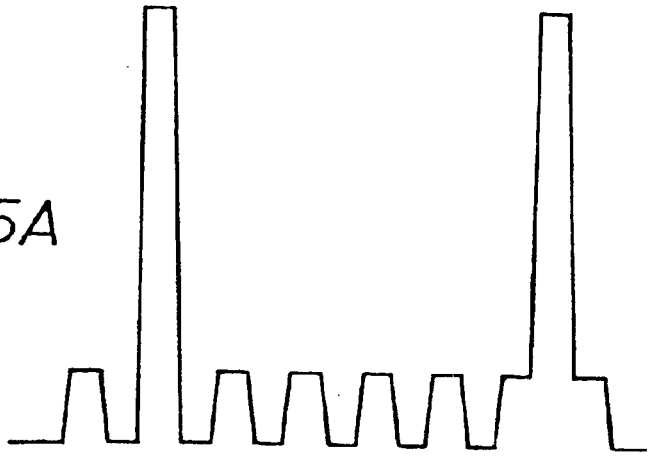
FIGS. 5A to 5D are signal waveform charts showing a method for driving the active-matrix liquid crystal display apparatus 29 of the embodiment of FIG. 3.
Figure 5B:
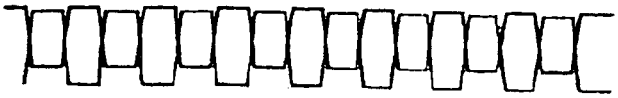
Figure 5C:
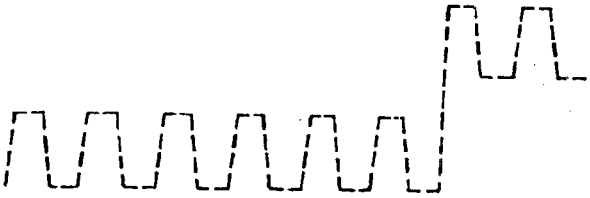
Figure 5D:
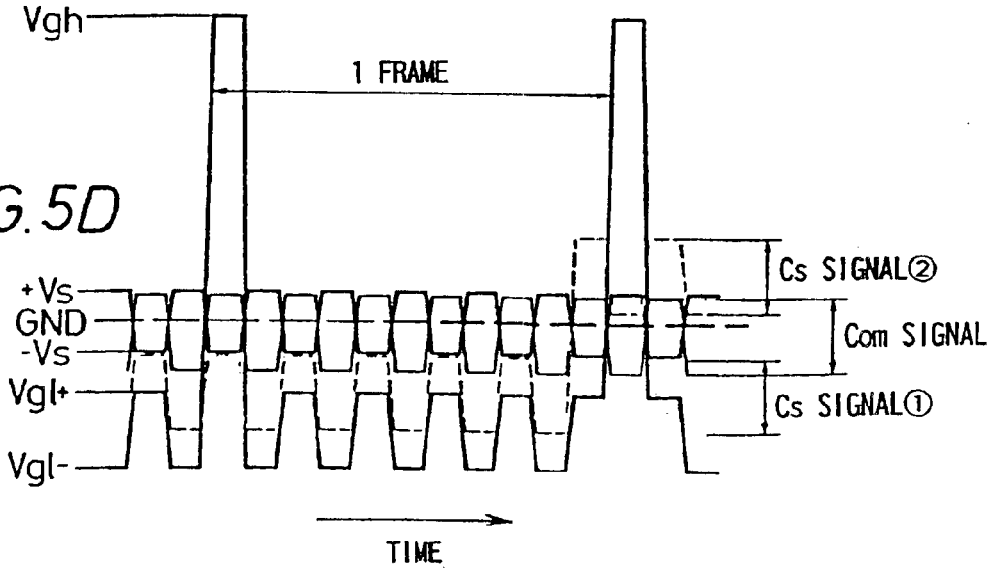

FIGS. 5A to 5D show a driving method in this embodiment. FIG. 5A shows a signal applied to the gate signal lines 21. FIG. 5B shows a signal applied to the common signal lines 26. FIG. 5C shows a signal applied to the supplementary capacitance lines 33. FIG. 5D shows these signals so as to be superposed on one another. In this embodiment, since the supplementary capacitance lines 33 are separated every gate signal line 21 and driven with the polarity being reversed every frame period, the deterioration of the V-T characteristic can be avoided.

Figure 6:
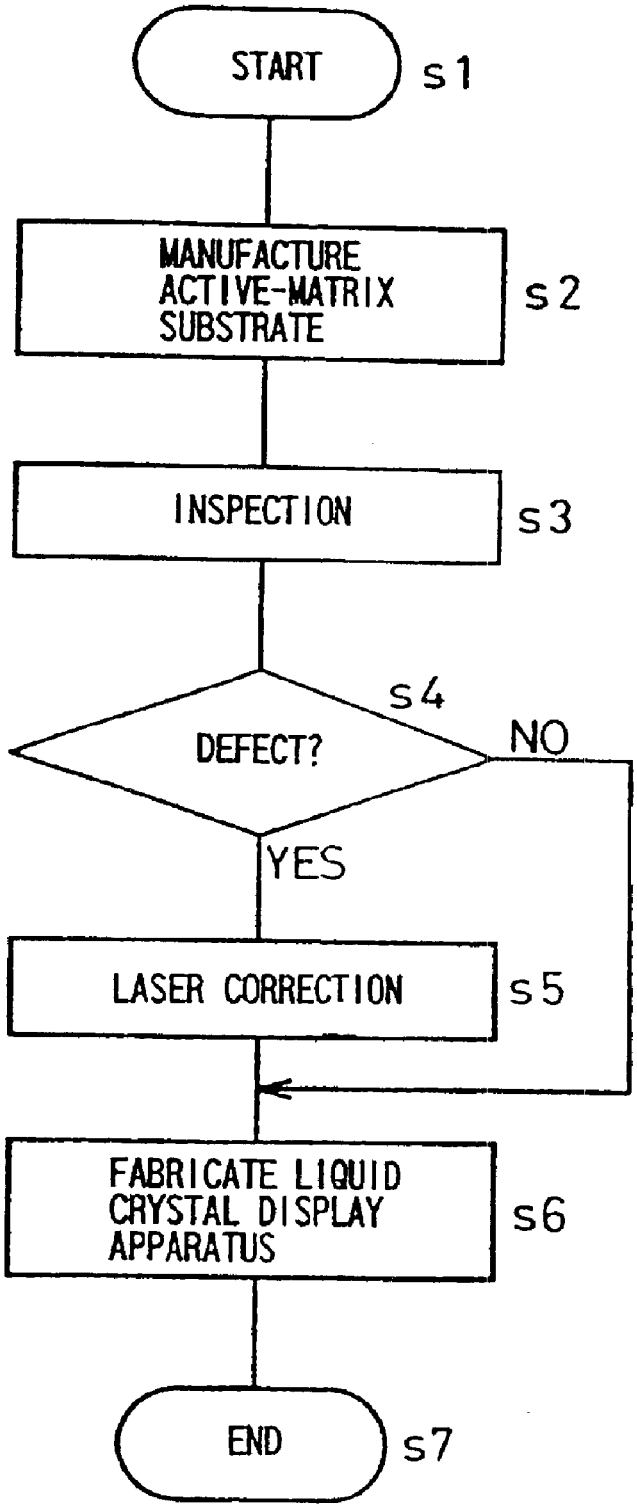
FIG. 6 is a flowchart showing the general outlines of a process for manufacturing the active-matrix liquid crystal display apparatus 19 or 29 shown in FIG. 1 or 3.

FIG. 6 shows the general outlines of a manufacturing process in which all the bright points due to defects on the active-matrix side can be corrected with a laser by use of the active-matrix liquid crystal display apparatus 19 or 29 of the embodiment shown in FIG. 1 or 3. The manufacturing process starts at step s1, and at step s2, the active-matrix substrate on which the TFTs 20, the gate signal lines 21, the source signal lines 22, the supplementary capacitance lines 23 or 33, the pixel capacitors 24 and the like are formed is manufactured. At step s3, the manufactured active-matrix substrate is inspected. At step s4, whether a defect is found through the inspection or not is determined. When it is determined that there is a defect, correction is performed by use of a laser. When it is determined at step s4 that there is no defect or when the correction using the laser is finished at step s5, the active-matrix liquid crystal display apparatus 19 or 29 is fabricated at step s6, and the manufacture is finished at step s7. In the normally-white mode active-matrix liquid crystal display apparatuses 19 and 29 of the embodiments, a bright point caused by a leakage of the supplementary capacitance 25 of the active matrix substrate is made inconspicuous, so that the yield can be improved. In the case of the normally-black mode active-matrix liquid crystal display apparatus, the yield can be improved by changing the black point to a halftone point in a similar manner. Moreover, since it is necessary only to cause the supplementary capacitances 25 to leak in the correction using the laser, the facilities can be simplified.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An active-matrix liquid crystal display apparatus comprising:

an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements;

a counter electrode substrate including a counter electrode formed thereon, the counter electrode being opposed to the pixel electrodes;

a liquid crystal sandwiched between the active-matrix substrate and the counter electrode substrate;

the active-matrix substrate further including supplementary capacitance lines which are formed in parallel to the scanning electrode lines, and supplementary capacitances for holding display data which are connected between the pixel electrodes and the supplementary capacitance lines, the apparatus further comprising:

a supplementary capacitance drive circuit for driving the supplementary capacitance lines based on a voltage applied to the counter electrode so that a predetermined potential difference between the voltage applied to the counter electrode and a voltage applied to the pixel electrodes which voltages are different from each other is always maintained when any of the pixel electrodes and supplementary capacitances leaks.

2. The active-matrix liquid crystal display apparatus of claim 1, wherein a display mode of the liquid crystal display apparatus is normally-white and the supplementary capacitance drive circuit drives the supplementary capacitance so that a potential difference not less than a threshold voltage of the liquid crystal is maintained between the pixel electrodes and the counter electrode.

3. The active-matrix liquid crystal display apparatus of claim 1, wherein the supplementary capacitance lines are separated from every scanning electrode line to which the switching element for switching-driving a pixel potential difference connected through the supplementary capacitance is connected at the intersection, and the supplementary capacitance drive circuit drives the supplementary capacitance lines with a polarity being reversed every time an on signal is input to the scanning electrode line driven at a stage preceding the scanning electrode line.

4. The active-matrix liquid crystal display apparatus of claim 2, wherein the supplementary capacitance lines are separated from every scanning electrode line to which the switching element for switching-driving a pixel potential difference connected through the supplementary capacitance is connected at the intersection, and the supplementary capacitance drive circuit drives the supplementary capacitance lines with a polarity being reversed every time an on signal is input to the scanning electrode line driven at a stage preceding the scanning electrode line.

5. The active-matrix liquid crystal display apparatus of claim 1, wherein the switching element and the pixel electrode are disconnected from each other at a pixel where the leakage between the pixel electrode and the supplementary capacitance line occurs.

6. The active-matrix liquid crystal display apparatus of claim 2, wherein the switching element and the pixel electrode are disconnected from each other at a pixel where the leakage between the pixel electrode and the supplementary capacitance line occurs.

7. The active-matrix liquid crystal display apparatus of claim 3, wherein the switching element and the pixel electrode are disconnected from each other at a pixel where the leakage between the pixel electrode and the supplementary capacitance line occurs.

8. An active-matrix liquid crystal display apparatus comprising:

an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrodes via the switching elements;

a counter electrode substrate including a counter electrode formed thereon, the counter electrode being opposed to the pixel electrodes;

a liquid crystal sandwiched between the active-matrix substrate and the counter electrode substrate;

the active-matrix substrate further including supplementary capacitance lines which are formed in parallel to the scanning electrode lines, and supplementary capacitances for holding display data which are connected between the pixel electrodes and the supplementary capacitance lines, the apparatus further comprising:

a supplementary capacitance drive circuit for driving the supplemental capacitance lines based on a voltage applied to the counter electrode so that a predetermined potential difference between the voltage applied to the counter electrode and a voltage applied to the pixel electrodes, which voltages are different from, each other, is always maintained.

9. An active-matrix liquid crystal display apparatus comprising:

an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements;

a counter electrode substrate including a counter electrode formed thereon, the counter electrode being opposed to the pixel electrodes;

a liquid crystal sandwiched between the active-matrix substrate and the counter electrode substrate;

the active-matrix substrate further including supplementary capacitance lines which are formed in parallel to the scanning electrode lines, and supplementary capacitances for holding display data which are connected between the pixel electrodes and the supplementary capacitance lines, the apparatus further comprising:

a supplementary capacitance drive circuit including a reference input maintained at the same potential as that of the common electrode for driving the supplementary capacitance lines based on the reference input so that a predetermined potential difference between a voltage applied to the counter electrode and a voltage applied to the pixel electrodes which voltages are different from each other, is always maintained when any of the pixel electrodes and supplemental capacitances leaks.

10. An active-matrix liquid crystal display apparatus comprising:

an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements;

a counter electrode substrate including a counter electrode formed thereon, the counter electrode being opposed to the pixel electrodes;

a liquid crystal sandwiched between the active-matrix substrate and the counter electrode substrate;

the active-matrix substrate further including supplementary capacitance lines which are formed in parallel to the scanning electrode lines, and supplementary capacitances for holding display data which are connected between the pixel electrodes and the supplementary capacitance lines, the apparatus further comprising:

a supplementary capacitance drive circuit for outputting to the supplementary capacitance lines, based on a voltage applied to the counter electrode, a voltage which (i) always has a predetermined potential difference from the voltage applied to the counter electrode and (ii) is different from the voltage applied to the counter electrode when any of the pixel electrodes and supplementary capacitances leaks.

11. An active-matrix liquid crystal display apparatus comprising:

an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements;

a counter electrode substrate including a counter electrode formed thereon, the counter electrode being opposed to the pixel electrodes;

a liquid crystal sandwiched between the active-matrix substrate and the counter electrode substrate;

the active-matrix substrate further including supplementary capacitance lines which are formed in parallel to the scanning electrode lines, and supplementary capacitances for holding display data which are connected between the pixel electrodes and the supplementary capacitance lines, the apparatus further comprising:

a supplementary capacitance drive circuit for outputting to the supplementary capacitance lines, based on a voltage applied to the counter electrode, a voltage which (i) always has a predetermined potential difference from the voltage applied to the counter electrode and (ii) is different from the voltage applied to the counter electrode.

12. An active-matrix liquid crystal display apparatus comprising:

an active-matrix substrate including a plurality of scanning electrode lines, a plurality of data electrode lines, pixel electrodes and switching elements, the pixel electrodes being respectively connected to intersections of the plurality of scanning electrode lines and the plurality of data electrode lines via the switching elements;

a counter electrode substrate including a counter electrode formed thereon, the counter electrode being opposed to the pixel electrodes;

a liquid crystal sandwiched between the active-matrix substrate and the counter electrode substrate;

the active-matrix substrate further including supplementary capacitance lines which are formed in parallel to the scanning electrode lines, and supplementary capacitances for holding display data which are connected between the pixel electrodes and the supplementary capacitance lines, the apparatus further comprising:

a supplementary capacitance drive circuit including a reference input maintained at the same potential as that of the common electrode for outputting to the supplementary capacitance lines, based on a reference input, a voltage which (i) always has a predetermined potential difference from a voltage applied to the counter electrode and (ii) is different from the voltage applied to the counter electrode, when any of the pixel electrodes and supplementary capacitances leaks.

* * * * *